United States Patent [19]

Solomon et al.

[11] Patent Number: 4,728,159

[45] Date of Patent: Mar. 1, 1988

[54] STACKABLE FILE STORAGE UNIT

[75] Inventors: Jack Solomon, Long Beach; Monte L. Levin, New York; Andrzej L. Soporowski, Freeport; Michael D. Jones, Rockville Center, all of N.Y.

[73] Assignee: Esselte Pendaflex Corporation, Garden City, N.Y.

[21] Appl. No.: 754,372

[22] Filed: Jul. 11, 1985

[51] Int. Cl.[4] ..... A47B 67/04

[52] U.S. Cl. ..... 312/111; 312/287; 312/320; 312/330 R; 220/22.3

[58] Field of Search ..... 312/111, 287, 330, 350, 312/11, 132, 320

[56] References Cited

U.S. PATENT DOCUMENTS

| | | | |
|---|---|---|---|
| 1,313,364 | 8/1919 | Williams | 312/287 X |
| 1,388,851 | 8/1921 | Cordes | 312/348 X |
| 3,487,945 | 1/1970 | Barham | 312/287 X |
| 3,604,775 | 9/1971 | Anderson | 312/330 |
| 3,929,386 | 12/1975 | Read | 312/341 N R |
| 4,378,137 | 3/1983 | Gibson et al. | 312/111 X |
| 4,526,427 | 7/1985 | Boll et al. | 312/111 |

FOREIGN PATENT DOCUMENTS

| | | | |
|---|---|---|---|
| 2554182 | 5/1985 | France | 312/111 |

*Primary Examiner*—Joseph Falk
*Attorney, Agent, or Firm*—Darby & Darby

[57] ABSTRACT

A file storage unit has a generally rectangular frame which is open at the front for receipt of a sliding drawer. The drawer has downwardly projecting ridges which slide along the interior of the frame. In addition, the front portion of the frame is provided with a snap-on reinforcing rim which acts to strengthen the unit and to accommodate the stacking of several units. A stop means is provided on the drawer which contacts a portion of the rim to prevent the drawer from being accidently withdrawn from the frame. Further, openings on the rear wall of the frame and in the handle of the drawer allow the unit to be conveniently carried.

12 Claims, 9 Drawing Figures

STACKABLE FILE STORAGE UNIT

BACKGROUND OF THE INVENTION

This invention relates to items suitable for storing personal or light business files and, more particularly, to stand-alone drawer files suitable for receiving folders containing personal or business documents.

Because of the large number of documents received in the average home which must be stored for a period of time, e.g. bills, tax forms, bank statements, etc., as well as documents received in typical small offices, there is an increasing need for file storage capacity. However, the typical storage unit is a multi-drawer cabinet made of heavy-duty metal. This makes the filing unit extremely heavy, and thus not portable, as well as relatively expensive. In addition, it is not possible to expand the conventional units. Therefore, additional storage space is achieved only by buying additional multi-drawer units, which may include much more space than the user actually needs.

While the standard file storage unit can be adapted through the use of metal frames to support hanging folders, the purchase of these frames represents an additional expense and also increases the total weight of the unit.

SUMMARY OF THE INVENTION

The present invention is directed to inexpensive, portable, single drawer filing cabinets which may be stacked one upon another to increase storage space as desired. The drawer of the cabinet is designed to accommodate hanging folders without the need for an additional frame. Further, convenient lift means are provided to allow the storage unit to be easily lifted by a user and carried to different locations. Despite its light weight, this stackable file has a relatively rigid construction and other features typical of the more expensive heavy metal cabinets commonly available in the prior art.

In an illustrative embodiment of the invention, the file storage unit includes a generally rectangular frame which is open at the front in order to receive a sliding drawer. A reinforcing rim is located about the periphery of the open front end of the frame to reinforce it. The drawer has longitudinal ridges which slide along the interior bottom wall of the frame. By making both the frame and the drawer of molded polystyrene plastic, the file storage unit is both light weight and inexpensive, and the drawer is provided with a relatively low friction sliding surface.

A projection at the back wall of the drawer is positioned to contact a portion of the reinforcing rim when the drawer is withdrawn from the frame so as to act as a drawer stop. In addition, a ledge forming a handle extends from the front panel of the drawer at approximately the same height above the bottom of the frame as an opening in the rear wall of the frame. Consequently, a user can carry the storage unit by grasping the handle at the front of the drawer with one hand and using his other hand to grasp the frame through the opening at the rear wall of the frame. In order to reduce pressure on the hand inserted through the opening in the rear wall, a flange is provided along the upper surface of the opening so that the force of the cabinet is spread out over the user's fingers.

In a preferred embodiment, the front rim is made of a flexible material having a generally C-shaped cross section that fits about both the interior and exterior of the periphery of the open end of the frame. The rim has projections spaced along the interior of the C-shape which are snapped into recesses in the front edge of the frame. Additionally, the drawer may contain a generally vertical follower plate which is slidably retained in a slot in the bottom panel of the drawer. At least one tooth on the follower plate and a series of teeth spaced along the slot in the bottom of the drawer are arranged to engage each other when the plate is tilted backward in the drawer but is permitted when the plate is tilted forward.

Because the reinforcing rim at the front of the unit causes it to tilt upwardly, feet can be supplied for attachment to the rear end of the unit so that it rests in a relatively balanced and level position. Also, projections from the front rim can engage a carpet or other surface upon which the unit is resting to prevent it from sliding.

In a still further embodiment of the invention, two or more file storage units can be stacked one upon the other. In such a case, the projections from the rim of the unit which are designed to engage a surface, such as a carpet, extend into recesses in the upper portion of the rim of the lower unit in a stacked. In addition, connecting pieces are arranged at the rear walls of the stack units such that they are held together and are level.

BRIEF DESCRIPTION OF THE DRAWINGS

The foregoing and other features of the present invention will be more readily apparent in the following detailed description and drawings of an illustrative embodiment of the invention in which.

DESCRIPTION OF AN ILLUSTRATIVE EMBODIMENT

Figure 1:
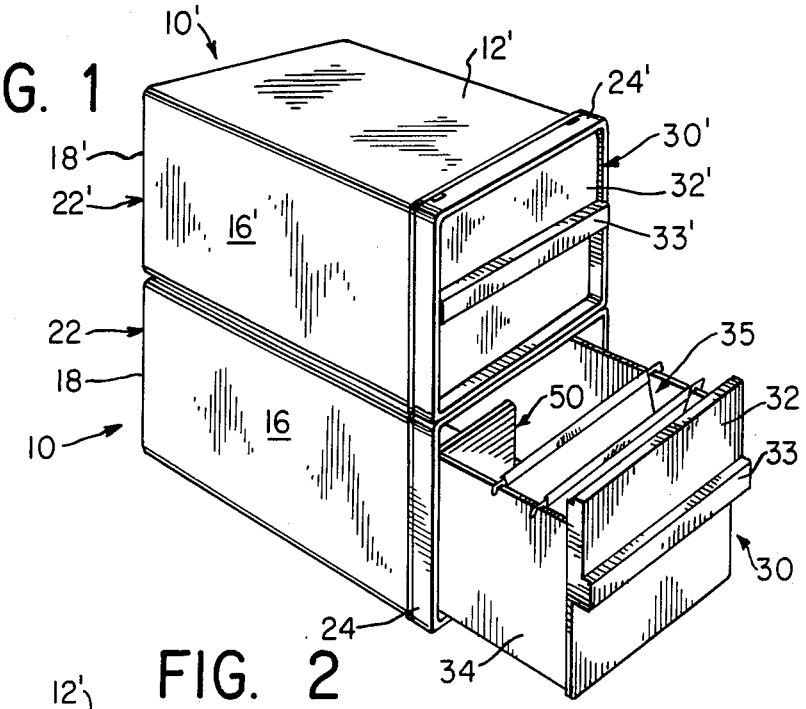
FIG. 1 is a perspective view of the invention showing two file storage units stacked one upon the other.

In FIG. 1 there are shown two file storage units 10, 10' stacked one upon the other. Each unit has a generally rectangular frame 22 which is typically made of molded or extruded polystyrene plastics material. As a result, the frame has a top wall 12, a bottom wall 14, two side walls 16 and a back wall 18 as shown more clearly in FIG. 2.

Figures 3, 4:
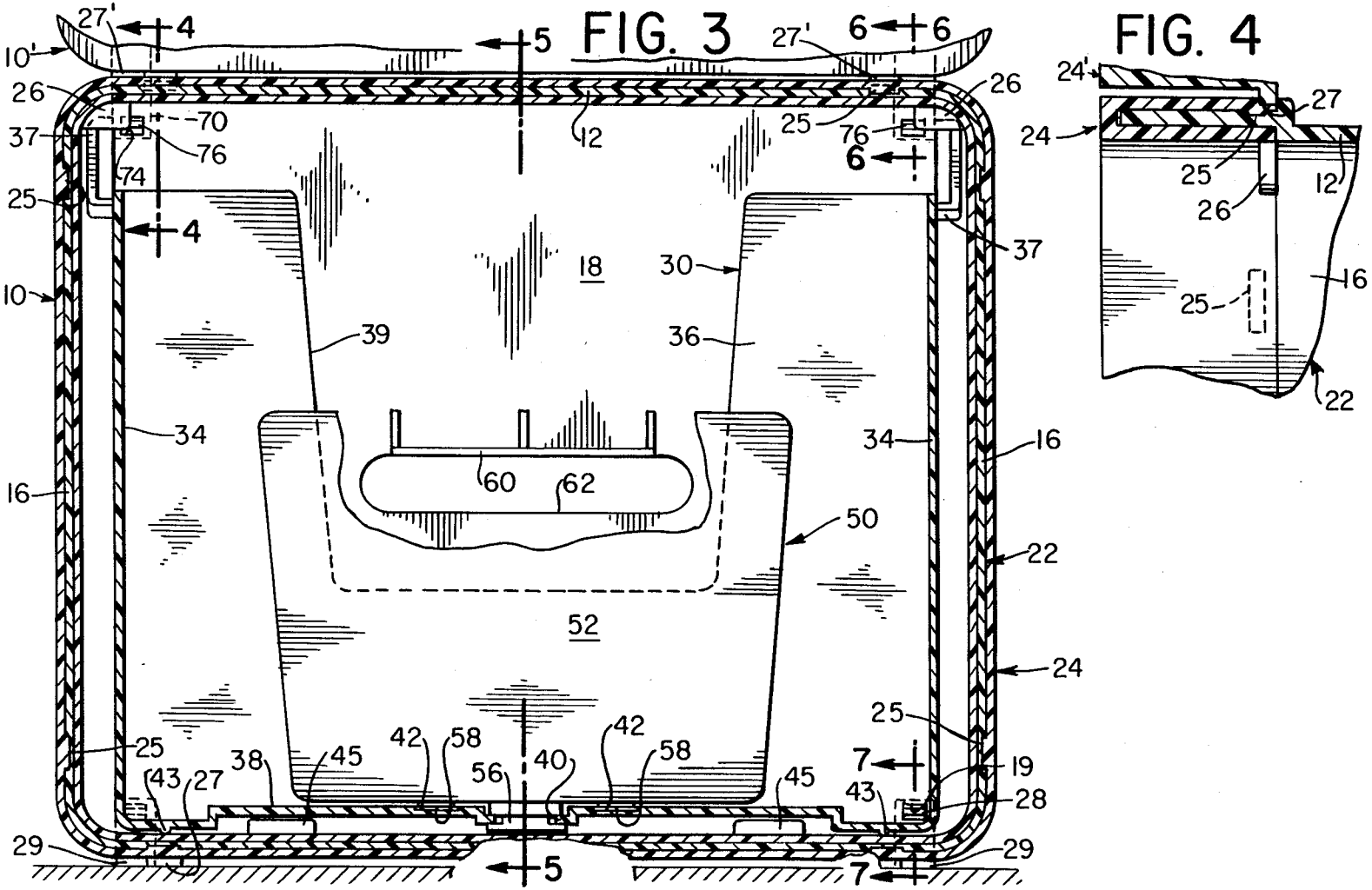
FIG. 3 is an enlarged cross section through the lower file unit shown in FIG. 2 along lines 3—3.
FIG. 4 is a sectional view of the front rim of the lower storage unit along lines 4—4 in FIG. 3.

At the forward edge of each frame 22, there is a reinforcing rim 24. This rim 24 has a generally C-shaped cross section as best seen in FIG. 4. As a result, the rim surrounds the interior and exterior front periphery of the open end of the frame. In order to assure that the rim will not slide off the frame, it is provided with dual projections 25 at each corner of the rim. These projections are received in recesses within the periphery of the open end of the frame.

Figure 2:
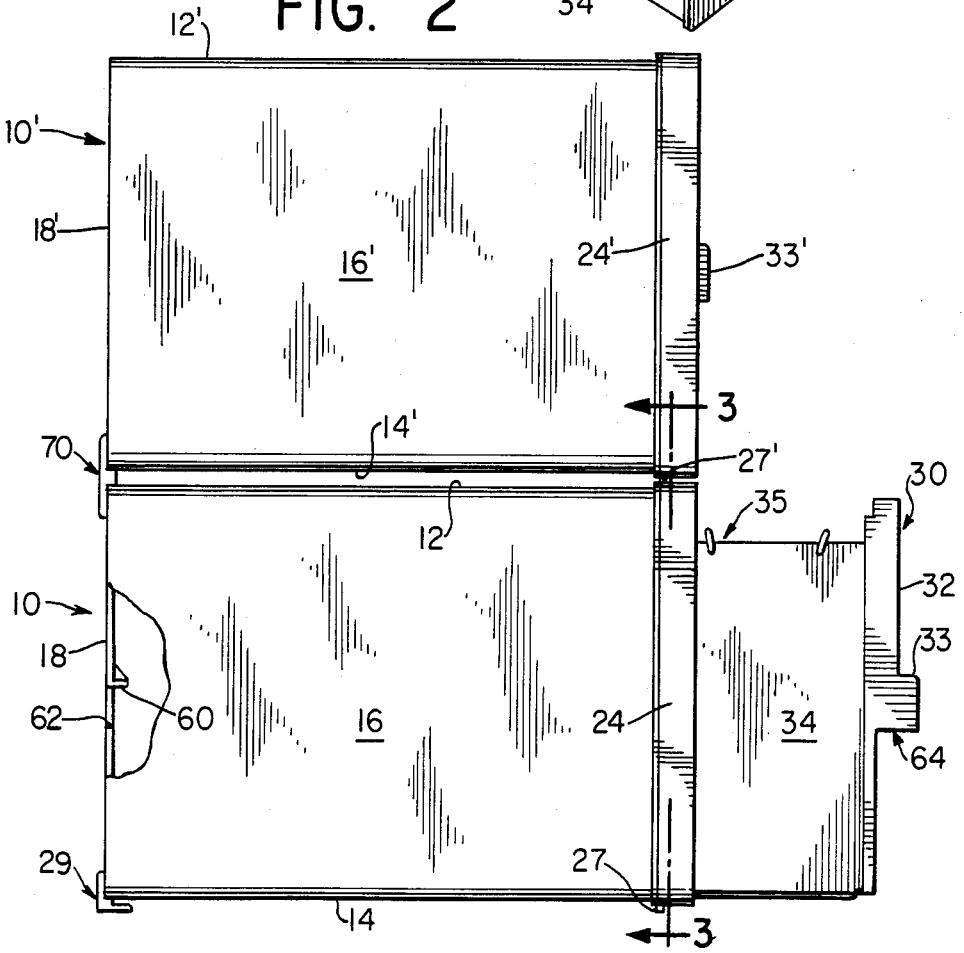
FIG. 2 is a partially broken side view of the file units of FIG. 1.
Figure 5:
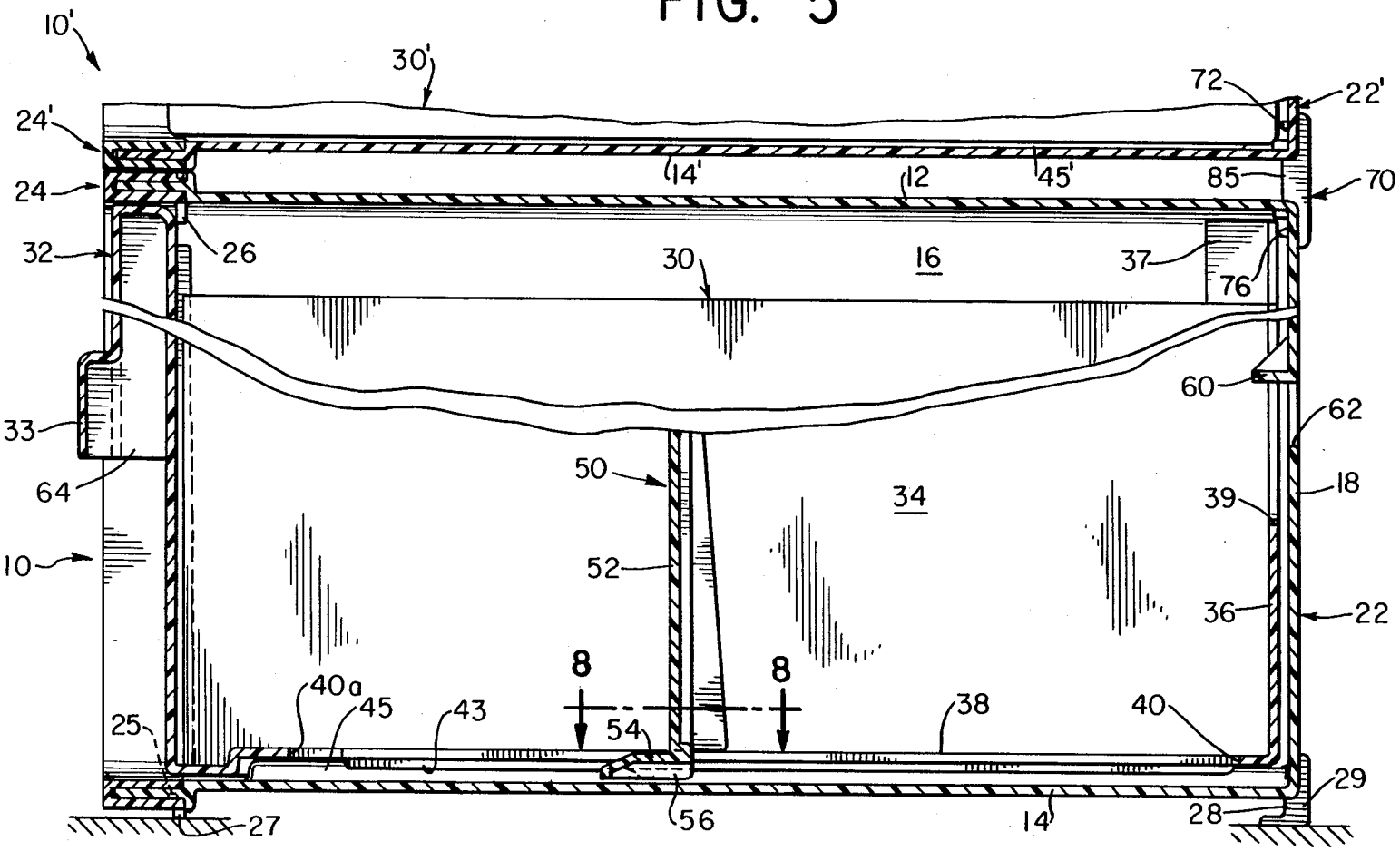
FIG. 5 is a longitudinal, partially broken cross section of the lower drawer along lines 5—5 as in FIG. 3.

At the lower edge of rim 24, there are outward and downward projections 27 (FIGS. 2 and 5) which are designed to engage the surface upon which the storage unit rests. This is especially useful when the storage unit is placed on a carpet. However, because of the projection 27 and the increased thickness of the rim 24 over the bottom wall 14 of the frame, the unit would have a higher elevation at the front than at the back. To compensate for this, foot members 29 are attachable to both corners of the bottom of the rear wall of the frame as shown in FIGS. 2 and 5.

Figure 7:
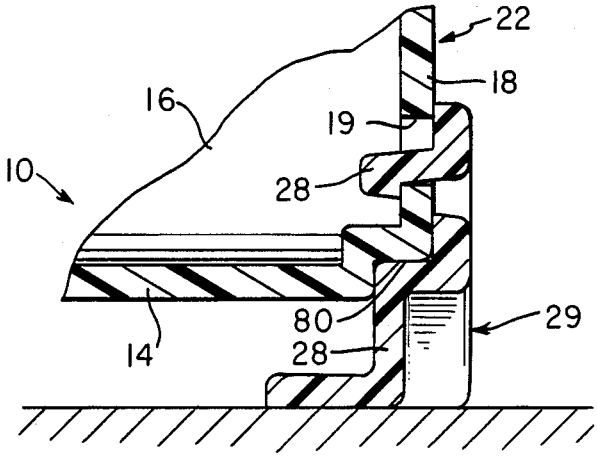
FIG. 7 is a greatly enlarged, partly broken, sectional view through the bottom foot of the storage unit along lines 7—7 in FIG. 3.

An enlarged view of foot member 29 is shown in Fig. 7. From FIG. 7, it can be seen that apertures 19 are provided in the bottom of the rear wall 18 of the frame. A portion 28 of foot member 29 extends through this aperture 19 and locks behind a portion of the rear wall 18. By making both the frame and the foot member of flexible plastics material, a snap-locking action between the foot member and the frame is achieved. As illustrated in the drawings, foot members are provided at either edge of the rear of the frame. However, additional foot members can be located at other convenient locations. For example, a foot member may be located at the middle of the rear edge of the bottom of the frame, if found necessary because of increased weight of the files stored in the unit.

Within the open front end of the storage unit, there is positioned a sliding drawer 30. This drawer is characterized by a front panel 32 with a projecting handle portion 33 which is open from the bottom to receive a user's hand as shown by opening 64 in FIGS. 2 and 5. Drawer 30 also includes side panels 34, a rear panel 36 and a bottom panel 38. The side panels are relatively high and are positioned to accept hanging partition folders 35 such as those sold by Oxford Pendaflex Company. Because of the high walls of the side panels 34, there is no need for the metal frame which is usually required to be installed in prior art file cabinets. Instead, the end hooks of file folder 35 can be located over the side walls 34 as shown in FIG. 1. As a result, the expense and weight of a support frame for file folders is eliminated with the present invention.

Towards the rear of side panels 34, there are stop members 37 at the upper edges as best shown in FIG. 3. These stop members 37 engage flanges 26 of the rim 24 when the drawer is fully extended from the frame. This prevents the drawer from being pulled completely out of the frame by accident. When it is desired to completely remove the drawer, the drawer is tilted upward so that the stop members 37 pass underneath flanges 26.

The bottom wall 38 of drawer 30 has longitudinal ridges 43 located along each exterior edge. These ridges are the surfaces upon which the drawer slides within the frame. By using these relatively narrow ridges to slide the drawer, there is reduced frictional contact and the drawer moves more easily. Also, since the drawer may be molded of plastics material and the interior of the frame is plastics material, a relatively low friction smooth sliding movement is achieved.

Projecting upwardly from the interior of the bottom wall 14 of the frame are longitudinal guide members 45. These members do not support the weight of drawer 30, but are positioned within a recessed portion of bottom wall 38 of the drawer and act to guide the drawer during movement. Thus, the guides 45 prevent the drawer from becoming cocked during insertion or removal.

Figure 8:
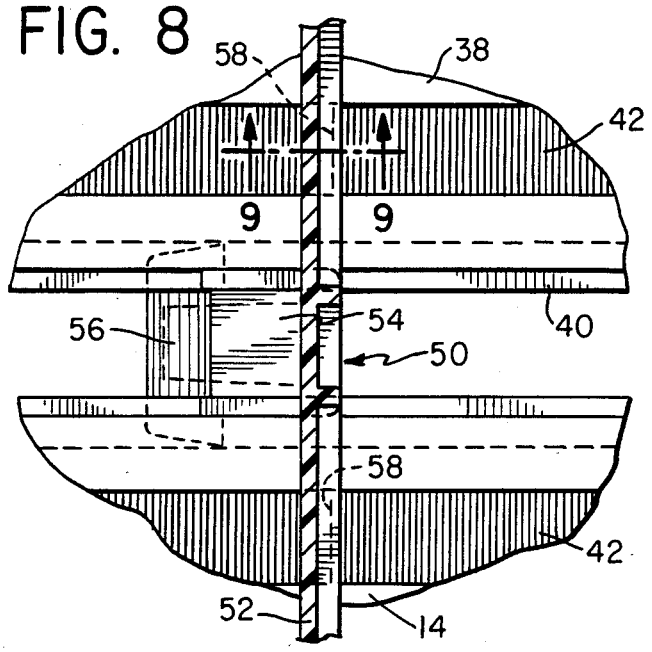
FIG. 8 is a partially broken sectional view of the follower member along lines 8—8 in FIG. 5.

The bottom panel 38 of the drawr also has a central slot 40 along which a follower member or block 50 is slidable. Follower block 50 is comprised of a generally vertical plate 52 which is arranged above and transverse to the slot 40. As seen in FIG. 8, the plate 52 has a lateral width which greatly exceeds that of the slot 40. this plate is adapted for pushing and holding files against the interior of the front panel 32 of the drawer. At the lower edge of plate 52 there is a narrowed portion 54 (FIG. 5) which extends through the slot 40 to a portion 56 located below the drawer bottom panel 38. As seen in dotted line in FIG. 8, the portion 56 also has a lateral width which exceeds the width of slot 40. Consequently, follower block 50 is trapped within slot 40 by the lateral dimensions of plate 52 and piece 56.

Figure 9:
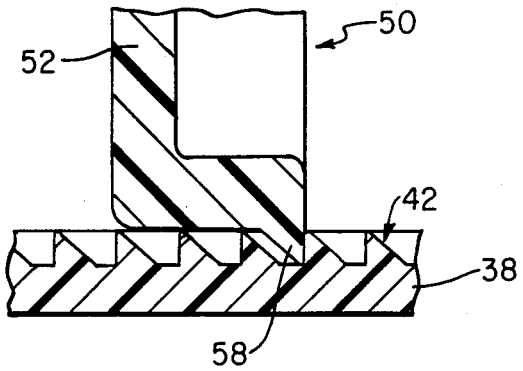
FIG. 9 is a greatly enlarged sectional view through the tooth of the follower plate and the teeth of the drawer bottom along lines 9—9 in FIG. 8.

On both sides of the slot 40, there are a series of teeth 42. Each of these series of teeth 42 is engaged by one of a pair of single teeth 58 projecting from the bottom portion of plate 52. An enlarged detail of this engagement is shown in FIGS. 8 and 9. Because of the arrangement of the pieces 54 and 56 with respect to slot 40, it is possible to tilt the plate 52 forward. By reference to FIG. 9, it can be seen that a forward or counterclockwise tilting of plate 52 will cause tooth 58 to come out of engagement with the teeth 42. This allows the follower member or block to be moved backward or forward along the slot 40. However, when the follower is pushed against a group of file in the forward section of the drawer, a generally clockwise force is applied to plate 52. This causes tooth 58 to extend into the teeth 42 and to prevent rearward movement in the direction of the arrow in FIG. 0. Thus, the follower block 50 provides an adjustable back wall for files stored in the drawer when the drawer is not full. As more files are added, the follower block is tilted forward and slid back to a new position to accommodate these additional files.

As best noted in FIG. 3, the rear panel 36 of the drawer has a large recessed portion 39. This provides easy access to files at the rear of the drawer and also provides space for a flange 60 which projects in from the rear wall 18 of the frame just above an aperture 62 in the frame. Aperture 62 and flange 60 are positioned with respect to the handle 33 (FIGS. 1 and 5), such that the storage unit may be easily lifted by a person extending their fingers through slot 62 and into opening 64 in the handle 33.

As shown in FIGS. 1 and 2, a similar storage unit 10' can be stored on top of the unit 10. Elements of storage unit 10' which are the same as in storage unit 10 are identified herein with the same reerence numbers, but they are marked with a prime. Additional units can be stacked to a height of four or five units, and perhaps even more, depending on the weight of the files stored within the units.

Figure 6:
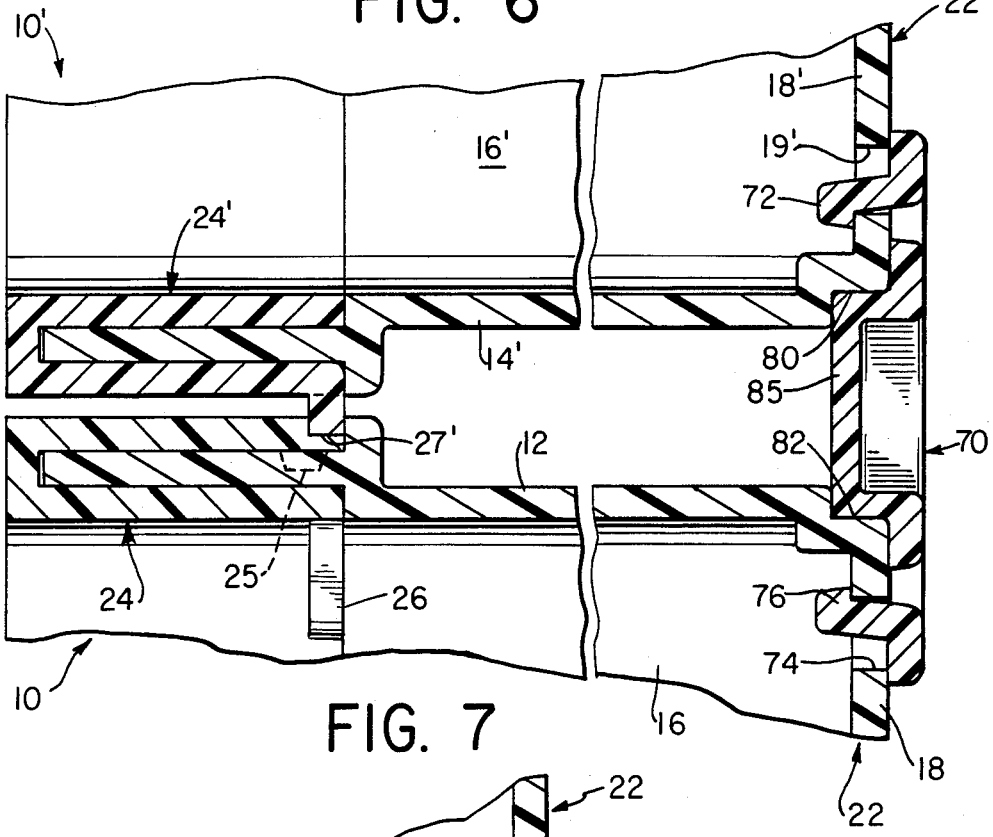
FIG. 6 is a greatly enlarged, partly broken, sectional view of the rear connection piece between stacked units taken along lines 6—6 in FIG. 3.

As noted above, the front rim and projection 27 on each frame would cause the front of the storage unit to be slightly higher than the rear portion. To compensate for this, the foot member 29 is used with the lower storage unit 10. On the upper unit 10' a connection piece 70 serves this purpose as well as acting to assure that the stacked units do not come apart. An enlarged view of the connection piece 70 is shown in FIG. 6, which figures also shows the interconnection between the front rims 24, 24' of the stacked units. The projection 27' of the upper unit, which is adapted to dig into a carpet or other support surface when used on the lower unit, is received within a recess in the upper portion of the frame 24 of the lower unit when two or more units are stacked. The projections 27' and the recesses are generally spaced at opposite corners of the upper edge of the frame as best shown in FIG. 3.

The connection piece 70 has a projection 72 which extends through opening 19' at the lower edge of the upper file unit 10' and makes a snap-in connection to that unit because of the resilience of the plastics material from which the connectipn piece 70 is made. This connection is in the same opening and made in the same manner as the foot piece 29. Located near the upper rear edge of the lower unit 10, is an aperture 74 which receives a projection 76 of connection piece 70 which snaps into the rear wall 18 of the lower frame in the same manner as projection 82 snaps into the rear wall 18' of the upper unit.

It will be noted in FIG. 6 that the connection piece 70 has a generally C-shaped cross section which fits within a downwardly open recess 80 in the upper frame and an upwardly open recess 82 in the lower frame. As a result, the height or separation between the two units towards the back is kept at a precise distance. This distance is arranged such that in stacking the units, they remain horizontal and level.

The frame 22, the rim 24, and foot piece 29 and the connection piece 70, can all be molded or extruded from plastics material, such as polystyrene, and thus are light in weight, strong and flexible, so as to promote the snap-in connections of these parts to each other. In addition, by making the parts of the storage unit of plastics material, it can be molded or extruded in various attractive colors and the unit is relatively inexpensive and easy to manufacture. Because of the light weight of the unit, the storage files are readily portable and, as additional storage space is needed, they can be stacked one upon the other. Also, if the file stack must be moved to a new location, they can be easily unstacked and moved one at a time.

Assembly of the storage unit is relatively simple since the various parts snap together. This includes the front rim 24 which is slipped onto the front edge of the frame until projections 25 of the rim snap into the recesses in the frame. Similarly, the feed 29 and connection pieces 70 snap into the frame. Finally, the follower block 50 can be inserted within the drawer by turning it parallel to the slot 40 and tilting it so that piece 56 passes through the slot 40. The follower block then rotated into its normal operating position. Thus, the present invention provides a useful, expandable storage unit which is attractive, simple to manufacture, relatively inexpensive and light in weight.

While the invention has been particularly shown and described with reference to a preferred embodiment thereof, it will be understood by those skilled in the art that various changes in form and details may be made therein without departing from the spirit and scope of the invention.

We claim:

1. A file storage unit comprising a frame having a top, bottom, back and two side walls, said frame having an open front, the back wall of said frame having a hand opening at a certain distance above the bottom wall and being of sufficient size to receive a user's hand, the upper edge of the hand opening being bordered by a flange projecting inwardly of said frame;

a reinforcing rim located about the periphery of the open front of said frame ; and a drawer having at least two spaced-apart, downwardly projecting narrow ridges, said drawer being slidable into the open front of said frame with the ridges sliding along the interior of the bottom wall of said frame, a reinforced drawer handle extending from a front panel of said drawer at approximately the same distance above the bottom wall of the frame as the flange of the hand opening.

2. A file storage unit as claimed in claim 1, wherein said rim is made of a flexible material with a generally C-shaped cross section that fits about both the interior and exterior of the periphry of the open front, said rim having projections spaced along the interior of the C-shape and being snapped into recesses correspondingly spaced along the interior and exterior portions of the periphery of the open front of said frame.

3. A file storage unit as claimed in claim 1, further including a drawer projection at the back of the drawer which contacts a portion of said reinforcing rim when the drawer is withdrawn from the frame so as to act as a drawer stop.

4. A file storage unit as claimed in claim 1, wherein said drawer includes a generally vertical follower plate slideably retained in a slot in a bottom panel of said drawer, said follower member having at least one follower tooth engaging a series of drawer teeth spaced along at least one side of the slot in said drawer bottom panel, the engagement of the follower tooth and the series of drawer teeth being such that sliding motion of the follower member is resisted when the follower member is tilted backward in said drawer and permitted when it is tilted forward.

5. A file storage unit as claimed in claim 1, wherein said drawer has side panels which are sufficiently high above a drawer bottom panel to support hanging folders.

6. A file storage unit as claimed in claim 1, wherein said drawer has at least one longitudinal recess in a bottom panel and said frame has a longitudinal raised portion arranged to be received in the recess of the drawer bottom panel so as to guide the drawer during movement within the frame, but without supporting the weight of the drawer.

7. A file storage unit as claimed in claim 1, wherein reinforced rim includes at least one outwardly and downwardly projecting stud, said stud being designed to engage the surface below the frame so as to resist movement of the frame on that surface.

8. A file storage unit as claimed in claim 1, wherein said storage unit further includes at least one foot member which attaches to a rear portion of the frame to compensate for the thickness of the reinforcing rim so as to level the storage unit.

9. A file storage unit as claimed in claim 8, wherein at least a second storage unit may be stacked on the first storage unit, the projecting stud of the second storage unit being received in a recess in the upper surface of said rim; and further including at least one connection piece extending between the bottom of the rear wall of the second storage unit and the top of the rear wall of the first storage unit, said connection piece having a length such that the second storage unit is level with the first when the rims of the first and second unit are in contact and the stud is in the recess.

10. A file storage unit as claimed in claim 9, wherein a plurality of storage units are stacked one on top of the other.

11. A file storage unit as claimed in claim 1, wherein the storage unit is made of molded polystyrene plastics material.

12. A file storage unit comprising a frame having a top, bottom back and two side walls, said frame having an open front, the back wall of said frame having a hand opening at a certain distance above the bottom wall and being of sufficient size to receive a user's hand, the upper edge of the hand opening being bordered by a flange projecting inwardly of said frame;

a reinforcing rim having a generally C-shaped cross section being located about the interior and exterior portions of the periphery of the open front of said frame, said rim being made of a resilient material and having rim projections spaced along the interior of the C-shape, said rim projections being snapped into corresponding recesses along the periphery of the open form of said frame; and a drawer having a front panel, a bottom panel and two side panels, at least two spaced-apart, downwardly projecting narrow ridges extend from the bottom of the bottom panel of the drawer, said drawer being slidable into the open front of said frame with the ridges sliding along the interior of the bottom wall of said frame, said drawer having a handle extending from the front panel of said drawer at substantially the same distance above the bottom wall of the frame as the flange of the hand opening, said drawer including a generally vertical follower slideable in a slot in the bottom panel of the drawer, said follower having at least one tooth that is engageable with one of a series of teeth on the bottom panel of the drawer such that sliding motion of the follower is resisted when it is tilted backward and permitted when it is tilted forward.

* * * * *